US006378218B2

(12) United States Patent
Sigwart et al.

(10) Patent No.: US 6,378,218 B2
(45) **Date of Patent: *Apr. 30, 2002**

(54) METHODS AND APPARATUS FOR MAKING A DRUG INFUSION DEVICE

(76) Inventors: Ulrich Sigwart, Chemin des Petoeyres 28, Morges (CH), 1110; Amir Abolfathi, 501 Forest Ave. Apt. 809, Palo Alto, CA (US) 94301; Farhad Khosravi, 1700 DeAnza Blvd. Apt. 212, San Mateo, CA (US) 94403; Isidro Gandionco, 36520 Alder Ct., Fremont, CA (US) 94536

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/068,635

(22) PCT Filed: Nov. 16, 1995

(86) PCT No.: PCT/US95/14998

§ 371 Date: Oct. 19, 1998

§ 102(e) Date: Oct. 19, 1998

(87) PCT Pub. No.: WO97/18067

PCT Pub. Date: May 22, 1997

(51) Int. Cl.[7] ..... B26F 1/32
(52) U.S. Cl. ..... 30/363; 30/366; 30/278
(58) Field of Search ..... 30/366, 363, 364, 30/358, 278, 280, 314; 83/660, 621, 628, 30, 54; 604/280, 282, 283, 284

(56) References Cited

U.S. PATENT DOCUMENTS

| | | | | | |
|---|---|---|---|---|---|
| 167,597 | A | | 9/1875 | Wilson | 30/121.5 |
| 183,771 | A | | 10/1876 | McGovern | 30/363 |
| 345,365 | A | * | 7/1886 | Cheswright | 83/160 |
| 401,918 | A | | 4/1889 | Woglom | 30/363 |
| 562,981 | A | | 6/1896 | Sprinkle | 30/363 |
| 849,312 | A | * | 4/1907 | Barnes | 30/363 X |
| 888,297 | A | * | 5/1908 | Bell | 30/363 |
| 1,076,732 | A | * | 10/1913 | Zimmerman | 30/363 |
| 1,407,056 | A | * | 2/1922 | Foote | 30/363 |
| 1,679,039 | A | * | 7/1928 | Kucera | 30/363 |
| 1,747,240 | A | * | 2/1930 | Haupt | 83/354 |
| 2,782,856 | A | * | 2/1957 | Staley | 30/363 |
| 3,158,157 | A | * | 11/1964 | Risk | 30/358 X |
| 3,232,298 | A | * | 2/1966 | Tomlinson | 30/358 X |
| 3,284,899 | A | * | 11/1966 | Mercorelli | 30/229 |
| 3,759,123 | A | * | 9/1973 | Van Zon | 83/54 |
| 3,883,953 | A | | 5/1975 | Saullo et al. | 30/304 |
| 3,901,113 | A | * | 8/1975 | Oltmans et al. | |
| 4,060,366 | A | * | 11/1977 | Johansson | 83/660 X |
| 4,104,942 | A | * | 8/1978 | Leloux | 83/327 |
| 4,149,695 | A | * | 4/1979 | Quick et al. | |
| 4,292,872 | A | * | 10/1981 | Brinker | |
| 4,416,039 | A | | 11/1983 | Miller | 27/21 |
| 4,554,849 | A | * | 11/1985 | Benham | |
| 4,616,540 | A | * | 10/1986 | Morhard | |
| 4,621,553 | A | * | 11/1986 | Gruchalski | |
| 4,669,191 | A | * | 6/1987 | Schramm | 30/358 |
| 4,768,693 | A | * | 9/1988 | Tomaszewski | 30/363 X |

(List continued on next page.)

*Primary Examiner*—Kenneth E. Peterson
(74) *Attorney, Agent, or Firm*—Fish & Neave; Nicola A. Pisano

(57) ABSTRACT

Methods and apparatus are provided for converting standard catheters or balloon catheters into drug infusion devices on an as-needed basis in a sterile environment, and which permit re-use of catheter devices previously used in a preceding non-invasive procedure. Apparatus is provided having a cavity for receiving a catheter device and a plurality of perforation pins or teeth for creating apertures in the catheter. Apparatus capable of converting a wide range of catheter devices into drug infusion devices is provided, which apparatus may be single-use disposable or re-sterilizable and re-usable.

7 Claims, 4 Drawing Sheets

U.S. PATENT DOCUMENTS 4,944,092 A * 7/1990 De Groot et al. ..... 30/134
4,970,926 A * 11/1990 Ghajar et al.
4,976,029 A * 12/1990 Kennedy ..... 30/114
5,031,613 A * 7/1991 Smith et al. ..... 128/207.14
5,067,241 A * 11/1991 Goodman ..... 30/289
5,291,663 A * 3/1994 Briglia et al. ..... 33/669

* cited by examiner

METHODS AND APPARATUS FOR MAKING A DRUG INFUSION DEVICE

FIELD OF THE INVENTION

The present invention relates generally to intraluminal and endoluminal drug infusion devices, and in particular, to low cost methods and apparatus for modifying and re-using catheters, including balloon catheters, for use in infusing drugs or other therapeutic agents.

BACKGROUND OF THE INVENTION

In recent years it has been discovered that the intraluminal or endoluminal infusion of drugs can significantly improve the results of certain non-invasive medical procedures. For example, it has been determined that infusion of drugs such as heparin or anti-inflammatory, thrombolytic or antibody products, after an angioplasty procedure, can reduce the risk of restenosis by preventing a proliferation of the cells that may cause such restenosis.

Devices have therefore been developed to provide a controlled delivery of drugs, either intraluminally or endoluminally, and which are inserted into the patient's vascular system subsequent to some other procedure involving catheterization. The infusion of drugs into the wall of a body vessel, for example, by means of an inflatable angioplasty balloon, is practicable and has been experimentally tested. Such techniques are described, for example, in the *Journal of the American College of Cardiology,* 1990:15:475 and *Circulation,* 1992:86:1–380.

In a typical less-invasive catheterization procedure, for example, a balloon angioplasty procedure to restore patency to a body vessel or a stent delivery procedure to prevent restenosis, the catheter device used to perform the angioplasty or stent delivery is typically a single use, disposable product. If a drug infusion step is performed, it typically requires that another catheter device, such as the Dispatch™ Coronary Infusion Catheter, sold by SciMed Life Systems, Maple Grove, Minn., be inserted in the body vessel.

A drawback of drug delivery devices such as the Dispatch™ catheter is the special-purpose nature of such devices. For example, while the drug delivery device may contain many parts in common with the catheter device used in the original angioplasty or stent delivery procedure, the drug delivery device may typically only be used after another instrument first has been used to treat the body vessel.

In addition, special purpose drug delivery devices require manufacturing, purchasing and handling costs beyond those required to perform the treatment procedure. For example, to provide a properly sized balloon-style drug delivery device for each application, a hospital or clinic must carry a complete inventory of such drug delivery devices, with an entire range of balloon diameters and drug delivery pore sizes, as may be required for occasional use.

Alternatively, combination angioplasty/drug infusion devices have been developed, as are described, for example, in U.S. Pat. No. 5,415,367 and PCT International Publication No. WO 94/21320. These devices are used both for performing an angioplasty procedure and for accomplishing a drug infusion step. A drawback of such devices, however, is the additional cost and specialized structure required to permit a single device to accomplish both the angioplasty and drug delivery tasks.

In view of the foregoing, it would be desirable to provide methods and apparatus that permit re-use of some or all of the components of a catheter device used in an initial treatment procedure, so that the components of the catheter device may be re-used in a drug infusion procedure.

It would further be desirable to provide low cost and easy-to-use methods and apparatus for modifying previously known angioplasty catheters and similar types of catheter devices for use in providing a drug infusion device.

It would further be desirable to provide low cost and easy-to-use methods and apparatus that permit conversion of previously known catheters, for example, angioplasty balloon catheters, into drug infusion devices on an as-needed basis, thereby eliminating the cost and handling problems associated with stocking an inventory of different types of drug delivery devices.

SUMMARY OF THE INVENTION

In view of the foregoing, it is an object of this invention to provide methods and apparatus that permit re-use of some or all of the components of a catheter device used in an initial treatment procedure, so that the components of the catheter device may be re-used in a drug infusion procedure.

It is a further object of the present invention to provide low cost and easy-to-use methods and apparatus for modifying previously known angioplasty catheters and similar types of catheter devices for use in providing a drug infusion device.

It is another object of this invention to provide low cost and easy-to-use methods and apparatus that permit conversion of previously known catheters, for example, angioplasty balloon catheters, into drug infusion devices on an as-needed basis, thereby eliminating the cost and handling problems associated with stocking an inventory of different types of drug delivery devices.

These and other objects of the invention are accomplished in accordance with the principles of the invention by providing methods and apparatus for modifying a catheter device, either previously unused or used, into a drug infusion device for intraluminal or endoluminal use on an as-needed basis. In accordance with the invention, methods and apparatus are provided for rapidly perforating, in a sterile environment, a standard catheter, or balloon of a balloon catheter, to permit the device to be used for a drug infusion task.

The apparatus of the present invention includes means for defining a cavity for receiving a catheter, and perforation means extending within the cavity for generating a plurality of perforations in the catheter either mechanically or electrically. The apparatus may be easily operated in a sterile catheterization environment, for example, on a angioplasty equipment table, without requiring any particular skill. When a drug or therapeutic agent, either a liquid, gas or solid suspension of drug eluting solids, is subsequently injected into the catheter, the drug or therapeutic agent exits the catheter through the perforations in a controlled manner.

In accordance with a first family of embodiments of the present invention, a plurality of pins are provided on at least one member of a pair of opposing members defining a cavity to receive a catheter. When the members are closed together about a catheter of either standard or balloon construction, the plurality of pins perforate the catheter.

In accordance with a second family of embodiments of the present invention, apparatus is provided having a cavity for receiving a catheter and holding the catheter in a predetermined relation to cam-actuated perforation means. Means are also provided for adapting the apparatus of the present invention for converting a wide range of sizes of previously known catheter devices to drug delivery devices, on an as-needed basis.

In accordance with the present invention, the apparatus of the present invention may be constructed of rugged materials permitting repeated re-sterilization and re-use. Alternatively, the apparatus of the present invention may be constructed of low cost materials to provide a sterile, single-use, disposable product.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
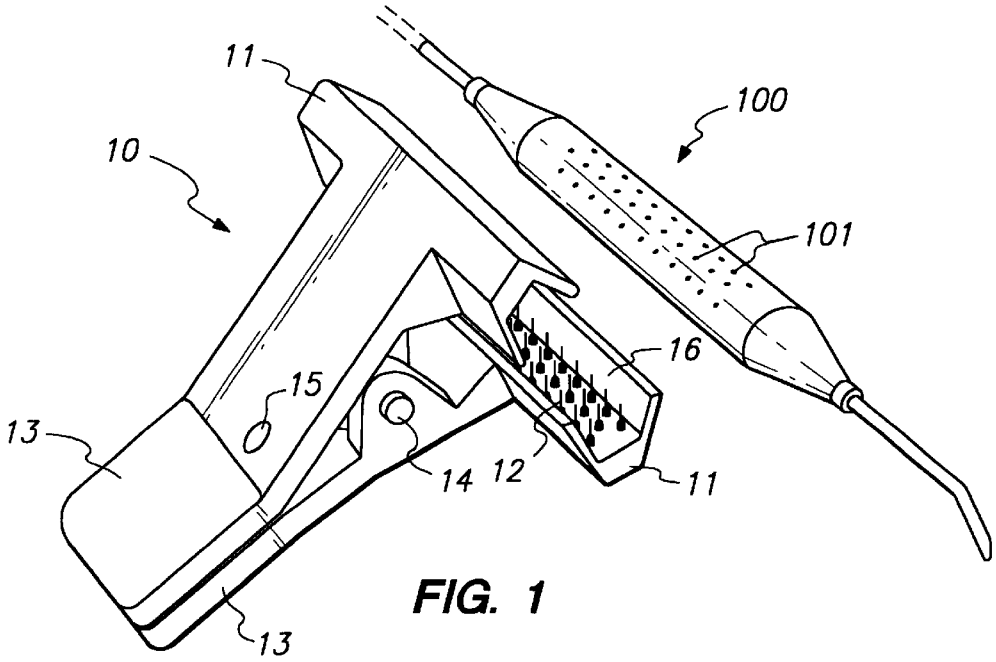
FIG. 1 is a perspective view of a first member of a first family of embodiments of apparatus constructed in accordance with the present invention and also shows the effect obtained by its application to an inflatable balloon catheter.
Figure 2:
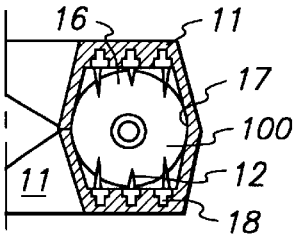
FIG. 2 is a cross-sectional view of the jaws of the embodiment of FIG. 1 shown in a closed position.

Referring to FIGS. 1 and 2, a first member of a first family of embodiments of the present invention is described. Generally, the first family of embodiments is characterized by the inclusion of opposing members having a plurality of mechanical or electrical perforation means, which opposing members may be closed together about a catheter or balloon catheter to create a drug infusion device.

In FIGS. 1 and 2, apparatus 10 comprises a pliers-type device having jaws 11 carrying a plurality of perforation pins 12. Perforation pins 12 are affixed within jaws 11 in a substantially parallel arrangement. Jaws 11 include grip members 13 joined at axis 14, and closure return spring 15 (only partially visible in FIG. 1) disposed about axis 14 that biases jaws 11 in a closed position.

When jaws 11 of apparatus 10 close together, they form a longitudinal passage 16 having an inner contour 17 that approximates the profile of a catheter or the balloon of a balloon catheter. For example, as shown in FIG. 2, inner contour 17 of apparatus 10 illustratively approximates the inflated diameter of inflatable angioplasty catheter balloon 100. Thus, when jaws 11 are closed together about catheter balloon 100, perforation pins 12 mechanically create a plurality of apertures 101 in the balloon.

In one embodiment of the apparatus 10, jaws 11 and grip members 13 are molded from a low cost rigid plastic material, and may be shaped identically. Perforation pins 12 may be integrally formed of a rigid plastic with jaws 11. Alternatively, perforation pins 12 may be formed from a suitable metal alloy, e.g., stainless steel, and placed in the mold for jaws 11 before molding, so that bases 18 of perforation pins 12 are embedded in jaws 11. In addition, if jaws 11 are molded of plastic, metal perforation pins may be implanted in jaws 11 after prior punching of suitable holes, the perforation pins being fixed by gluing or by force-fitting in the holes. Any of these modes of construction are expected to provide apparatus which are relatively economical for mass production.

Perforation pins may also create apertures in the catheter device to be perforated other than by mechanical means. For example, perforation pins may be electrically heated, so that they melt through, rather than mechanically puncture, the catheter device. Alternatively, perforation pins may be connected to an RF power source to serve as electrodes for creating porosity in the catheter or balloon.

As will be apparent from the above description of apparatus 10, operation of apparatus 10 to convert a standard catheter device or balloon catheter to a drug infusion device is straightforward. An illustrative use of apparatus 10 is described with respect to FIGS. 1 and 2 to effect perforation of a plurality of holes 101 in the wall of the balloon angioplasty catheter 100.

Balloon catheter 100 is first removed from its packaging, or if previously used in an angioplasty procedure, rinsed with sterile saline solution. While grip members 13 of apparatus 10 are squeezed together to open jaws 11, balloon 100 is seated in longitudinal passage 16. The pressure on grip members 13 is then relaxed, permitting jaws 11 to close together by recoil of closure return spring 15. Jaws 11 are then firmly held closed together while balloon 100 is inflated.

As balloon 100 expands, its outer wall contacts perforation pins 12, thereby creating a plurality of apertures in the outer wall of balloon 100. Balloon catheter 100 is then deflated, grip members 13 are squeezed together to open jaws 11, and balloon catheter 100 is removed from longitudinal passage 16. Balloon catheter 100 may then be inserted transluminally into a patient, and using a suitable syringe or pressure bag, a drug or a therapeutic agent is injected into balloon catheter 100.

As will of course be appreciated, if it is desired to inject the drug or therapeutic agent endoluminally (i.e., so that it penetrates into the linings of a body vessel wall), the drug or therapeutic agent must be injected into balloon catheter 100 in a manner sufficient to expand the balloon into contact with the vessel wall, i.e., at least initially, the flow of drug or therapeutic agent exiting the balloon is lower than the rate at which it is being injected into the balloon by the syringe or pressure bag. Alternatively, if it is desired merely to provide intraluminal injection, the balloon may be only partially inflated, or not at all.

As will further be appreciated in view of the foregoing, the number, length, thickness, orientation and positioning of perforation pins in apparatus 10, as well as all other embodiments of the present invention described herein, depend upon the specific requirements of a particular application for a drug infusion device made using apparatus 10. These characteristics may vary, in particular, according to the number of apertures desired per unit of length of the balloon or catheter, and the distribution of the apertures around the contour of the balloon or catheter.

For example, the cross section of the passage between jaws 11 of apparatus 10 may be of any desired shape, as long as its contour approximately envelops the cross section of the catheter or balloon to be inflated, depending on the length and orientation of the perforation pins. Moreover, perforation pins 12 may create apertures in a catheter having any number of shapes, for example, slits, holes, etc., and such characteristics as are depicted herein are not to be considered limiting.

Figure 3:
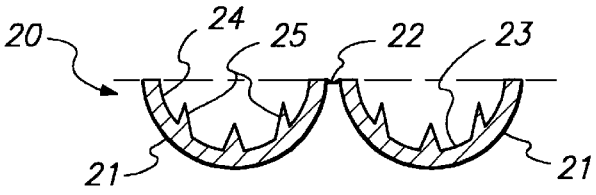
FIG. 3 is a cross-sectional view of a second member of the first family of embodiments of apparatus constructed in accordance with the principles of the present invention.

Referring now to FIG. 3, apparatus 20, representative of a second member of the first family of embodiments of the present invention, is described. Apparatus 20 features great ease of fabrication, for example, and may be molded as a single piece of plastic.

Apparatus 20 comprises two semi-cylindrical shells 21, joined by a longitudinal articulation formed of a thin junction band 22. Junction band 22 is produced during the plastic molding process and is commonly referred to as a "living-hinge." Lower walls 23 of shells 21 comprise the jaws of the device and provide contour 24 that envelops the catheter or balloon catheter in a closed position. Plurality of substantially parallel perforation pins 25 extends inwardly from lower walls 23, and may be integrally formed therewith.

Operation of apparatus 20 will be apparent from inspection of FIG. 3 and the foregoing description relating to apparatus 10. An advantageous cost feature of this embodiment is that a wide variety of different configurations of apparatus 20 may be stocked by a hospital or clinic at a much lower cost than that associated with stocking an inventory of differently shaped drug infusion devices. Consequently, a suitable apparatus 20 may be selected for a single, disposable use to create a drug infusion device for a particular application from either a new or previously used standard or balloon catheter, and on an as-needed basis.

As noted hereinabove, the orientation of the perforation pins 25 inside the jaws may be other than substantially parallel, as a matter of design choice. Likewise, shells 21 need not be connected by an integral joint, although such construction may be advantageous from a fabrication standpoint.

Figure 4:
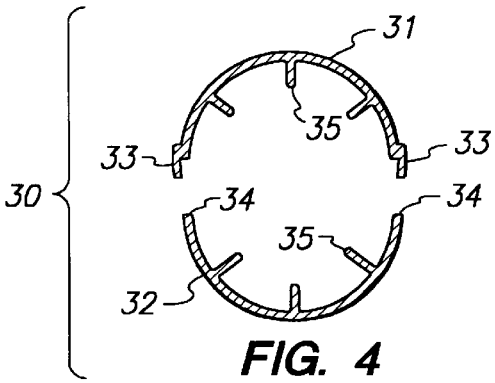
FIG. 4 is a cross-sectional view of a third member of the first family of embodiments of apparatus constructed in accordance with the principles of the present invention.

Thus, as described with respect to apparatus 30 of FIG. 4, the jaws may be independent of each other and comprise two half-cylinders 31 and 32. Half-cylinders 31 and 32 may be formed, for example, of stainless steel. Half-cylinder 31 includes two longitudinal lateral rims 33, offset toward the outside, between which the two longitudinal free edges 34 of half-cylinder 32 engage in a closed position, to facilitate manual juxtapositioning of the half-cylinders.

Each half-cylinder 31 and 32 has a plurality of radially disposed perforation pins 35, which may be formed, for example, by punching or embossing triangular elements into the walls of half-cylinders 31 and 32. When half-cylinders 31 and 32 are assembled in a closed position, the cross section of the resulting cylinder comprises approximates the contour of the catheter section being perforated, as in all the members of the first family embodiments of the present invention.

Figure 5:
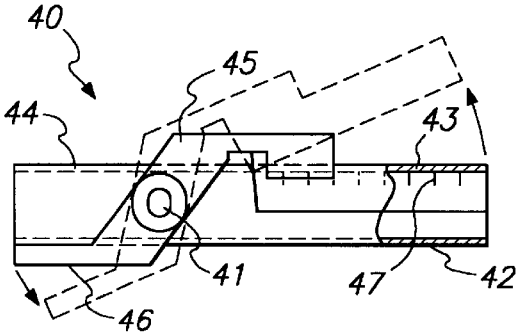
FIG. 5 is a side elevation view of a fourth member of the first family of embodiment of apparatus constructed in accordance with the principles of the present invention.

Referring now to FIG. 5, apparatus 40 representing yet another member of the first family of embodiments is described. Apparatus 40 is presented in the form of a pliers, wherein the joint between the jaws is not parallel to the longitudinal extent of the jaws. In particular, apparatus 40 includes joints 41 having an axis that is perpendicular to the longitudinal extent of jaws 42 and 43. Jaw 42 continues and forms part of tube 44, having an inside cross-section corresponding to the partial contour of the catheter or balloon to be perforated. Jaw 43 is connected by two lateral arms 45 to joints 41 comprising two lateral pivots fixed to tube 44. Lateral arms 45 are prolonged opposite tube 44 and are connected by handle 46. In apparatus 40, only pivoting jaw 43 includes perforation pins 47 on its inner surface.

As will of course be understood from the foregoing, alternatives of the first family of embodiments shown may be designed, either by modifications of shapes or by combinations of their structures. Thus, for example, for small balloons of short length, apparatus 10 of FIGS. 1 and 2 may have a width, in the direction of the joint axis, equal to the length of the passage 16 between the two jaws. In this case, passage 16 can be formed of two grooves of adequate cross section formed in jaws 11.

Figure 6A:
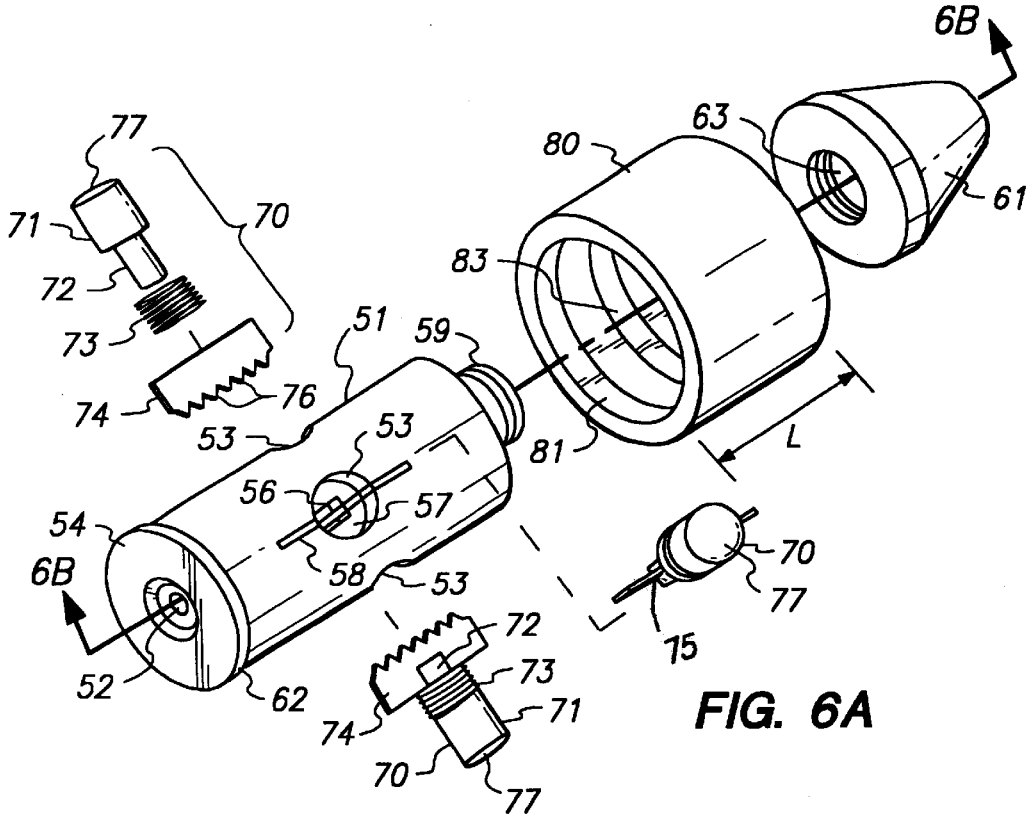
FIGS. 6A and 6B are, respectively, exploded perspective and longitudinal cross-sectional views of a first member of a second family of embodiments of the present invention.
Figure 6B:
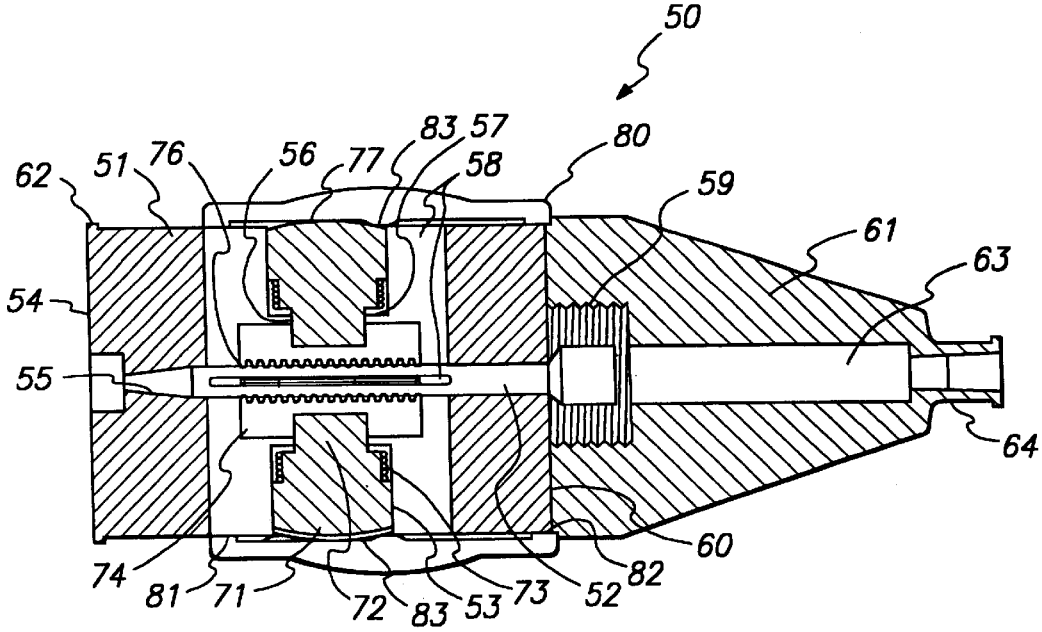

Referring now to FIGS. 6A and 6B, a first member of a second family of embodiments constructed in accordance with the present invention is described. Generally, the second family of embodiments is characterized by a cavity for receiving a catheter and holding the catheter in a predetermined relation to cam-actuated perforation means.

Apparatus 50 in FIGS. 6A and 6B includes cylindrical block 51 having a central bore 52 and a plurality of radial bores 53 distributed about its circumference. As seen in FIG. 6B, central bore 52 extends through distal endface 54 of block 51, and may include tapered region 55. Each of radial bores 53 terminates in a recess 56 that accommodates an inward motion of a blade holder, described hereinafter, and ledge 57. Longitudinal slots 58 are disposed in block 51 along a diameter of radial bores 53 and recesses 56, and communicate with central bore 52. Block 51 may include threaded portion 59 extending from its proximal endface 60 to threadedly engage closure block 61.

Disposed within each of radial bores 53 is a perforation assembly 70 comprising actuator button 71 including blade holder 72, spring 73 and blade 74. Blade holder 72 includes a portion defining slot 75, so that blade 74 may be engaged, for example, by friction-fitting, within slot 75. Each blade 74 includes a plurality of perforation teeth 76. Perforation assembly 70 is slidingly disposed within radial bore 53 so that blade 74 is disposed in slot 58 and blade holder 72 can enter recess 56 in block 51 when perforation assembly 70 is fully depressed in an inward direction in radial bore 53. Spring 73 is captured against ledge 57 surrounding recess 56 to bias perforation assembly 70 in an outward direction. Actuator button 71 includes raised surface 77 that projects above the outer diameter of block 51 when spring 73 biases perforation assembly 70 to an outward position.

Sleeve 80 is disposed in sliding relation about the outer diameter of block 51 and is captured between rim 62 at the distal end of block 51 and closure block 61. Sleeve 80 includes flanges 81 and 82 at either end that provide a close-fitting sliding relation between sleeve 80 and block 51. In a preferred embodiment, sleeve 80 has a length L that is greater than one-half of the length of block 51, so that flanges 81 and 82 do not contact raised surfaces 77 of actuator buttons 71 during proximal and distal movement of sleeve 80.

Sleeve 80 further includes on its interior surface raised cam surface 83 that contacts raised surfaces 77 of actuator buttons 71 when sleeve 80 is moved in the proximal and distal directions along block 51. When sleeve 80 is moved in the distal-to-proximal direction or vice versa, cam surface 83 depresses perforation assemblies 70 radially inward against the bias of spring 73 so that blades 74 extend into central bore 52. At either end of its travel, i.e., when sleeve 80 is either moved to its distal-most position or proximal-most position, cam surface 83 does not contact raised surfaces 77 of the perforation assemblies.

Closure block 61 includes central bore 63 aligned with central bore 52 in block 51. Closure block 61 is threadedly engaged to threaded portion 59 of cylindrical block 51, and serves as a proximal stop for sliding movement of sleeve 80. Closure block 61 further serves as a grip for supporting apparatus 50 during sliding movement of sleeve 80, and may also provide flange 64 for accepting a coupling.

Apparatus 50 may be constructed of sturdy materials that enable the apparatus to be re-sterilized and re-used repeatedly. Alternatively, apparatus 50 may be constructed primarily of rigid molded plastic, with only springs 73 and blades 74 formed of a metallic material. This latter construction would permit an economical, single-use, disposable product.

Operation of apparatus 50 is now described with respect to FIGS. 6A and 6B. Similar to operation of apparatus 10, 20, 30 and 40 of the first family of embodiments, apparatus 50 is employed to puncture a plurality of apertures in a standard catheter or balloon catheter to convert the catheter device into a drug infusion device.

Apparatus 50 may be used on either a new catheter, or in a sterile environment, immediately subsequent to another non-invasive procedure, to convert a previously used catheter device into a drug delivery device. For example, once an angioplasty procedure has been completed, the catheter or balloon catheter used in that procedure may be rinsed in a sterile solution, and then, in a sterile environment, be perforated using apparatus 50 to accomplish a drug delivery task.

Use of apparatus 50 is illustratively described with respect to creating apertures in a balloon of a balloon catheter, although the modifications to these steps required to perforate a non-inflatable catheter will be apparent. Apparatus 50 is employed by first inserting a distal balloon of a balloon catheter through central bore 63 and central bore 52 so that the tip of the balloon catheter is visible through endface 54 of block 51.

The balloon is then inflated to fill central bore 52, and sleeve 80 is moved in a proximal or distal direction (depending upon the present position of sleeve 80) so that cam surface 83 depresses perforation assemblies 70. As perforation assemblies 70 are depressed against the bias of springs 73, perforation teeth 76 of blades 74 puncture the balloon to create apertures in the balloon. As sleeve 80 completes its travel, cam surface 83 moves off of raised surfaces 77 of perforation assemblies 70 and perforation teeth 76 are withdrawn from the balloon by the outward bias of spring 73.

The punctured balloon may then be transluminally inserted into a patient's body vessel for a drug delivery task. As noted hereinabove, when a drug or therapeutic agent is injected into the balloon, the balloon inflates while the drug or therapeutic agent flows out of the apertures created by apparatus 50. Depending upon the number, size and orientation of the apertures and the pressure at which the drug or therapeutic agent is supplied, the drug or therapeutic agent may exit through the apertures with sufficiently high velocity to penetrate the wall of the body vessel. The drug infusion step may be continued over a course of minutes using a syringe to pressurize the balloon, or over a longer period of time if a pressure bag is attached to the balloon, as is conventional for previously known drug infusion devices.

Figure 7A:
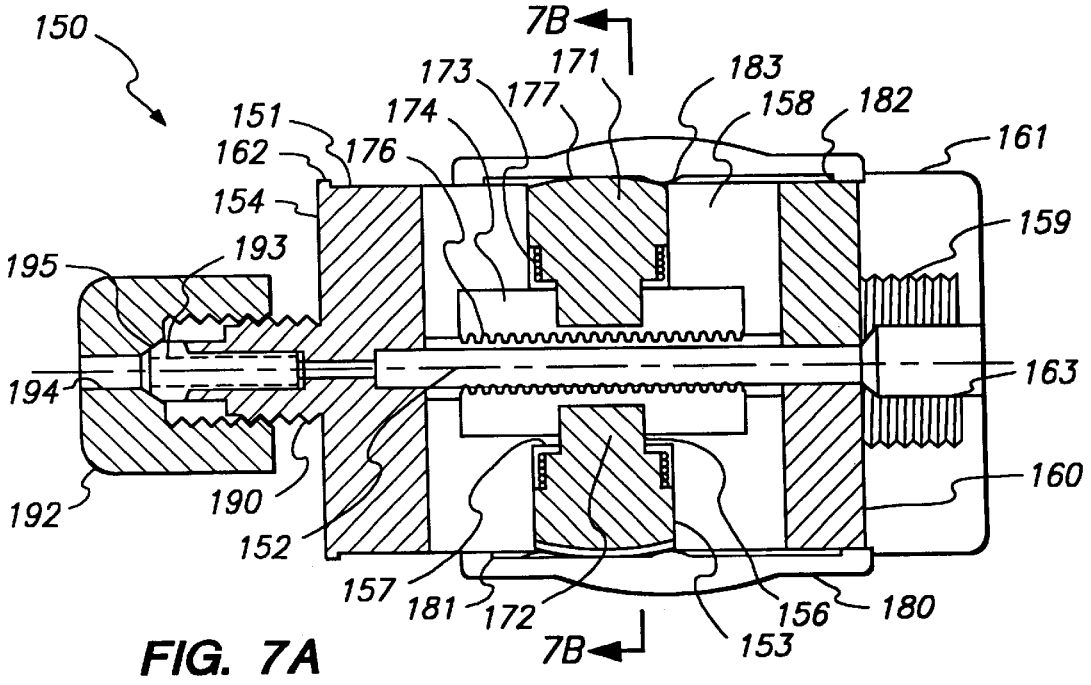
FIGS. 7A and 7B, are, respectively, longitudinal and diametral cross-sectional views of a second member of the second family of embodiments of the present invention.
Figure 7B:
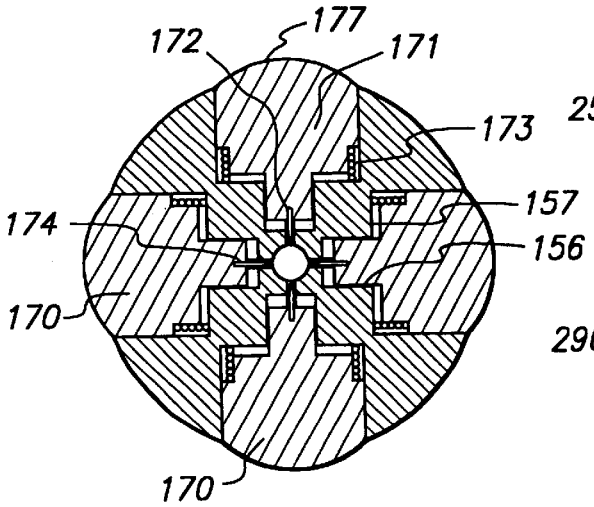

Referring now to FIGS. 7A and 7B, apparatus 150 representing a second member of the second family of embodiments is described. Like parts of apparatus 150 are indicated by like-numerals to the parts of apparatus 50, increased by 100. Thus, for example, the cylindrical block of apparatus 150 is referred to as block 151. As will be apparent from inspection of FIGS. 7A and 7B, apparatus 150 includes cylindrical block 151, perforation assemblies 170, closure block 161 and sleeve 180 substantially as described above with respect to apparatus 50 of FIGS. 6A and 6B.

Apparatus 150 further includes threaded portion 190 disposed from distal endface 154 of block 151, and endcap 192 threadedly engaged with threaded portion 190. Elastic member 193 is disposed in bore 194 that communicates with central bore 152 of block 151. Elastic member 193 includes a bore that communicates with central bore 152 to receive the distal end of a catheter device to be perforated. Elastic member 193 further includes a ring portion interposed between the distal end of threaded portion 190 and beveled interior surface 195 of endcap 192.

Endcap 192 and elastic member 193 of apparatus 150 serve to lock a catheter device to be perforated in position within apparatus 150 in the following fashion. First, the catheter or deflated balloon is inserted into central bore 152 through central bore 163 of closure block 161. The distal end of the catheter or balloon is then urged along central bore 152 until the tip of the catheter is visible through bore of endcap 192.

Endcap 192 is then tightened onto threaded portion of block 151, whereby beveled interior surface 195 urges the ring portion of elastic member 193 against the endface of threaded portion 190. This action reduces the inner diameter of the ring portion of elastic member 193, and effectively locks the catheter device into position within apparatus 150, thereby avoiding inadvertent longitudinal movement of the catheter within central bore 152 during the perforation step.

Figure 8A:
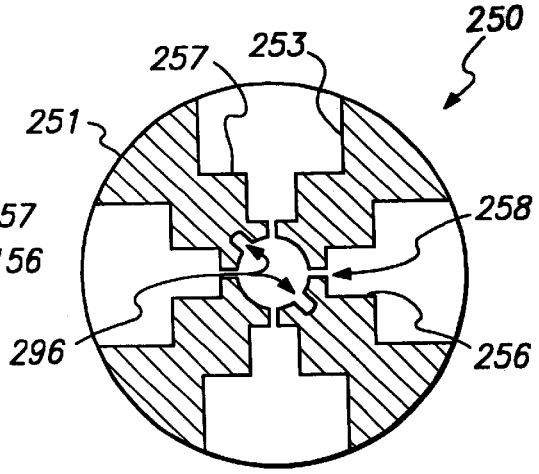
FIGS. 8A and 8B, are, respectively, a diametral cross-sectional view of, and a centering member for use with, a third member of the second family of embodiments of the present invention.
Figure 8B:
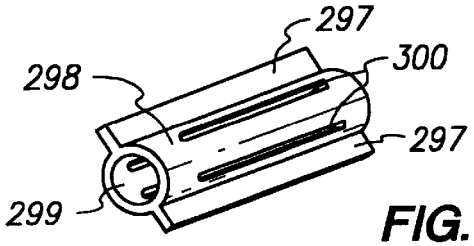

Referring now to FIGS. 8A and 8B, apparatus 250 representing a third member of the second family of embodiments is described. Like parts of apparatus 250 are indicated by like-numerals to the parts of apparatus 150, increased by 100. Thus, for example, the cylindrical block of apparatus 250 is referred to as block 251. Except as otherwise described hereinbelow, the components of apparatus 250 are substantially as described above with respect to apparatus 50 and 150.

In FIG. 8A, which corresponds to a cross-section similar to that of FIG. 7B (taken along view line 7B—7B of FIG. 7A), cylindrical block 251 is shown having oversized central bore 252 and longitudinally-oriented key slot 296. Referring now also to FIG. 8B, key slot 296 accepts wings 297 of plug 298. Plug 298 includes bore 299 and longitudinal slots 300 that permit the perforation teeth of perforation assemblies 270 (not shown) to extend into bore 299 when sleeve 280 (not shown) depresses perforation assemblies in the fashion described hereinabove with respect to the embodiments of FIGS. 6 and 7.

The foregoing arrangement enables apparatus 250 to be used to perforate a wide range of catheter devices in the following manner. Oversized central bore 252 (not shown) is dimensioned to accept plugs 298 having a variety of diameters and bores 299. When a catheter or balloon of a given size is to be perforated, plug 298 having a bore 299 appropriate for that size catheter or balloon is loaded into oversized bore 252 so that wings 297 of the plug are slidingly engaged in key slot 296.

Endcap 292 (not shown) is then coupled to block 251 and the catheter or balloon to be perforated is then inserted into bore 299 of plug 298 via central bore 263 of closure block 261 (not shown). Plug 298 therefore holds the catheter or balloon concentrically within oversized bore 252, so that when perforation assemblies 270 are depressed by sleeve 280, blades 274 pass through longitudinal slots 300 of plug 298 and into bore 299 to perforate the catheter or balloon located therein.

Figure 9:
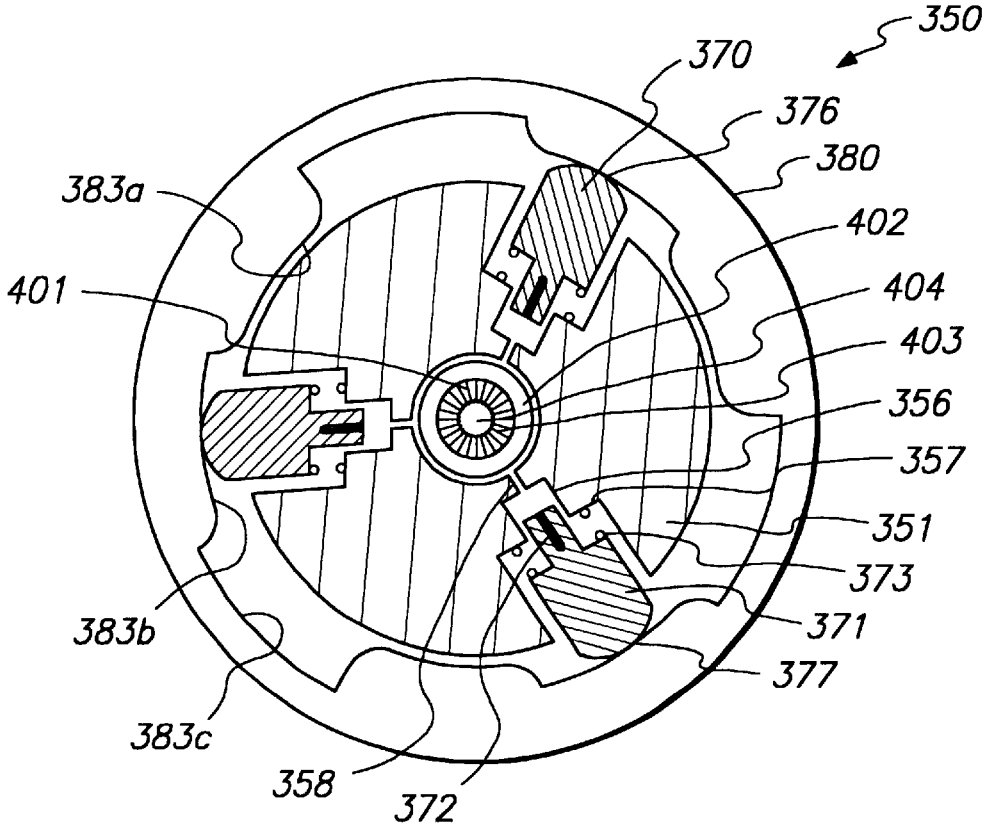
FIG. 9 is a diametral cross-sectional view of a fourth member of the second family of embodiments of the present invention.
Figure 10:
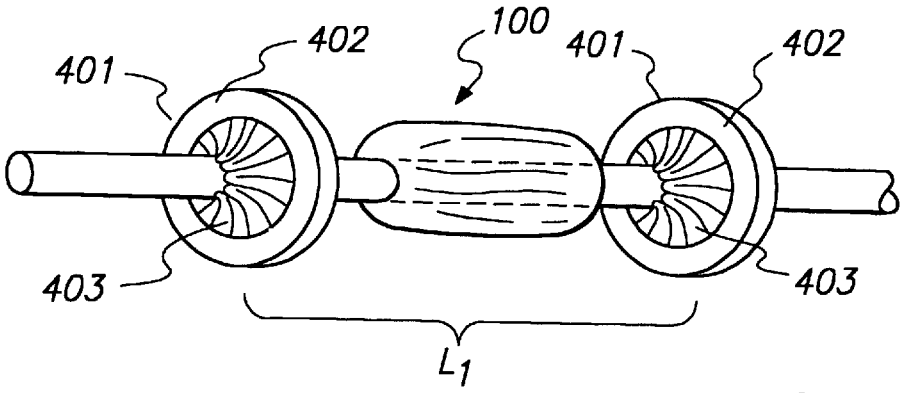
FIG. 10 is a perspective view, in isolation, of the centering members of the embodiment of FIG. 9 holding a distal end of a balloon catheter.

Referring now to FIGS. 9 and 10, apparatus 350, representing an alternative embodiment of apparatus 250 is described. Like parts of apparatus 350 are indicated by like-numerals to the parts of apparatus 150, increased by 200; except as otherwise described hereinbelow, the components of apparatus 350 are configured and operate substantially as described hereinabove. FIG. 9 corresponds to a cross-section similar to that of FIG. 7B, and shows cylindrical block 351 having oversized central bore 352 and centering ring 401 disposed therein.

Referring now also to FIG. 10, centering rings 401 are spaced apart a distance $L_1$ and fixed within oversized central bore 352 (not shown) proximally and distally of the ends of slot 358, so as not to interfere with operation of perforation assemblies 370. Centering rings comprise outer rings 402 having a multiplicity of flexible fingers or bristles 403 extending in a radially inward direction toward central aperture 404. Central aperture 404 has a diameter about as small as the smallest catheter device to be perforated by apparatus 350. Multiplicity of flexible fingers or bristles 403 enable centering rings to accommodate a variety of catheter diameters by flexing in proximal or distal directions, while ensuring that the catheter or balloon is centered within oversized central bore 352.

Sleeve 380 includes cam surface illustratively having a series of steps 383*a*, 383*b* and 383*c* and indexing means (not shown), for example, a spring-loaded ball bearing, to select and maintain a desired cam surface in alignment with raised surfaces 376 of perforation assemblies 370. Steps 383*a*, 383*b* and 383*c* depress perforation assemblies 370 by different amounts, thus causing blades 374 (not shown) to penetrate into oversized central bore 352 to a greater or lesser degree. Steps 383 may have radiused edges where they transition from one height to another.

For example, if step 383*a* of cam surface 383 is used to actuate perforation assemblies, blades 374 will be advanced much further into central bore 352 than if step 383*b* is used. Likewise, step 383*b* results in a greater depth of penetration than step 383*c*. The step 383*a*–383*c* of cam surface 383 selected to perforate a given catheter device may be selected by rotating sleeve 380 in a clockwise or counterclockwise manner to bring the desired step of the cam surface into alignment with raised surfaces 376 of the perforation assemblies.

Apparatus 350 therefore provides a universal perforation device, since any of a wide range of catheter device may be held concentrically within central bore 352 by centering rings 401, and the depth of penetration of perforation assemblies 370 may be readily adjusted by rotating sleeve 380. Consequently, the need to disassemble the apparatus, for example, to replace plug 298 of the apparatus of FIGS. 8A and 8B is obviated, as is the need to stock plugs 298 of different sizes.

Apparatus constructed in accordance with the second family of embodiments described hereinabove may include any number of perforation assemblies to provide perforations either equi-spaced or grouped around the periphery of a standard catheter or balloon catheter. For example, apparatus 150 illustratively includes four perforation assemblies, while apparatus 350 includes only three. Of course, a greater or lesser number may be used depending upon the intended application of the drug delivery device.

As will further be appreciated in view of the foregoing description of the second family of embodiments, the number, length, thickness and positioning of teeth on the blades of the perforation assemblies in apparatus 50, 150, 250 and 350, depend upon the specific requirements of a particular application for a drug infusion device. These characteristics may vary according to the number of apertures desired per unit of length of the balloon or catheter, and the distribution of the apertures around the contour of the catheter device. In addition, the teeth of the perforation assemblies may create apertures in a catheter having any number of shapes, for example, slits, holes, etc., and such characteristics as are depicted herein are not to be understood to be limiting.

While preferred illustrative embodiments of the present invention are described above, it will be obvious to one skilled in the art that various changes and modifications may be made therein without departing from the invention and it is intended in the appended claims to cover all such changes and modifications which fall within the true spirit and scope of the invention.

What is claimed is:

1. Apparatus for converting a catheter device, including a standard catheter or balloon catheter, into a drug infusion device, the apparatus comprising:

a housing defining a concave cavity configured to receive a catheter device, the cavity comprising upper and lower surfaces, the housing further comprising a key slot communicating with the cavity;

means for centering the device within the cavity comprising a plurality of plugs adapted to engage the key slot, each one of the plurality of plugs having a bore of different diameter;

a plurality of pins extending within the cavity from the upper and lower surfaces, the plurality of pins adapted to create perforations in a portion of the catheter device; and means for locking the catheter device in position within the cavity.

2. The apparatus as defined in claim 1 wherein the apparatus is dimensioned to convert a plurality of catheter devices, each one of the plurality of catheter devices having a different exterior diameter.

3. The apparatus as defined in claim 2 wherein the plurality of pins further comprise at least one perforation assembly, and the apparatus further comprises a member defining a cam surface for selectively actuating the at least one perforation assembly, the cam surface including a plurality of steps of different heights.

4. The apparatus as defined in claim 1 wherein the plurality of pins further comprise at least one perforation assembly, the apparatus further comprising a member defining a cam surface for selectively actuating the at least one perforation assembly.

5. The apparatus as converting a catheter device, including a standard catheter or balloon catheter, into a drug infusion device, the apparatus comprising:

a housing defining a concave cavity configured to receive a catheter device, the cavity comprising upper and lower surfaces;

means for centering the device within the cavity comprising at least one ring having a multiplicity of flexible fingers or bristles;

a plurality of pins extending within the cavity from the upper and lower surfaces, the plurality of pins adapted to create perforations in a portion of the catheter device; and means for locking the catheter device in position within the cavity.

6. The apparatus as defined in claim 5 wherein the apparatus is configured to convert a plurality of catheter devices, each one of the plurality of catheter devices having a different exterior diameter.

7. The apparatus as defined in claim 5 wherein the plurality of pins further comprise at least one perforation assembly, the apparatus further comprising a member defining a cam surface for selectively actuating the at least one perforating assembly.

* * * * *